US006700494B2

(12) United States Patent
Dowd

(10) Patent No.: US 6,700,494 B2
(45) Date of Patent: Mar. 2, 2004

(54) EQUINE TRACKING

(76) Inventor: Dennis O. Dowd, Two Beverly Rd., West Orange, NJ (US) 07052

( * ) Notice: Subject to any disclaimer, the term of this patent is extended or adjusted under 35 U.S.C. 154(b) by 0 days.

(21) Appl. No.: 10/197,033

(22) Filed: Jul. 17, 2002

(65) Prior Publication Data

US 2003/0016135 A1 Jan. 23, 2003

Related U.S. Application Data

(60) Provisional application No. 60/306,563, filed on Jul. 19, 2001.

(51) Int. Cl.[7] ..... G08B 23/00

(52) U.S. Cl. ..... 340/573.3; 340/573.1; 340/323 R

(58) Field of Search ..... 340/572.1, 573.1, 340/573.2, 573.3, 323 R; 463/17, 40, 42; 342/357.09, 357.1, 453, 457

(56) References Cited

U.S. PATENT DOCUMENTS

| | | | | |
|---|---|---|---|---|
| 4,333,072 A | | 6/1982 | Beigel | |
| D321,069 S | | 10/1991 | Stoddard, III | |
| 5,214,409 A | | 5/1993 | Beigel | |
| 5,235,326 A | | 8/1993 | Beigel et al. | |
| 5,731,788 A | * | 3/1998 | Reeds | 340/323 R |
| 5,894,266 A | | 4/1999 | Wood, Jr. et al. | |
| 6,323,771 B1 | * | 11/2001 | Payne et al. | 340/573.1 |
| 6,373,508 B1 | * | 4/2002 | Moengen | 345/848 |
| 6,512,478 B1 | * | 1/2003 | Chien | 342/357.09 |
| 6,554,188 B1 | * | 4/2003 | Johnson et al. | 340/572.1 |
| 6,567,038 B1 | * | 5/2003 | Granot et al. | 342/44 |

FOREIGN PATENT DOCUMENTS

| | | |
|---|---|---|
| WO | WO 99/53339 | 10/1999 |
| WO | WO 00/48132 | 8/2000 |
| WO | WO 01/14905 A1 | 3/2001 |
| WO | WO 02/21151 A1 | 3/2002 |

* cited by examiner

*Primary Examiner*—Van Trieu
(74) *Attorney, Agent, or Firm*—McCarter & English LLP; Allen N. Friedman

(57) ABSTRACT

The invention addresses resolution of serious deficiencies in the timing and movement of racing animals at racetracks and other locations. These needs are met by utilizing, refining, and applying modern computer satellite and tracking technology to an antiquated industry. The technology to be utilized includes adaptations of computer chips currently in domestic pet location use, global positioning satellite technology and on board transponders and uses modern communication technologies to centralize information flow and dissemination for efficient management of many respects of the animal racing industry.

12 Claims, 2 Drawing Sheets

EQUINE TRACKING

PRIORITY

This application claims priority from Provisional Application Ser. No. 60/306,563, filed Jul. 19, 2001.

BACKGROUND OF THE INVENTION

1) Field of the Invention

This invention is in the field of horse race industry management.

2) Brief Description of the Background Art

The horseracing industry currently uses a number of methods in thoroughbred and harness racing to calculate the speed that a horse competes in a race or in the case of thoroughbred to also calculate the speed that a horse performs during a workout. In addition, racetracks assign stalls for horses based upon an anticipation that the animals to which these stalls are assigned will compete at the racetrack giving them the residence. Racetracks do not normally charge for stall use. There is an understanding that the owners/trainers of the horses will compete at the meet. The relationship between the owners and trainers is one under which a trainer takes horses in his care and reports to the owner from time to time as to the horse's progress and work.

Timing Problems

Timing is done currently by two methods. During a race, thoroughbred or harness, including harness-qualifying races, timing is done by the racetrack via a teletimer unit operated by an individual and who is assisted and/or acts himself as a charter (Other forms of animal racing such as dogs, mules and camels would be subject to the same methodology). The teletimer unit gives the fractional timing at various poll locations on the track via electric eye. The lead horse breaks the beam and then the charter computes by sight the distance each horse is behind that horse and then makes a time adjustment. This information is then printed in the horse's past performance and/or chart. The accuracy of all horses, other than the lead horse, is dependent upon the accuracy of the charter and is subject to human error. Mistakes are commonplace as published in an article in the May 17, 2001 Daily Racing Form correcting the chart in the recently run Kentucky Derby, the world's most watched race.

In thoroughbred racing there are no qualifying races however there are "published workouts". Thoroughbred racetracks in the morning are congested with horses that are exercising on the track. In addition to the normal exercise routine engaged in by these horses certain horses "work", that is they travel a distance and are timed. These times are then published and relied upon by the public. The system is essentially an honor system where the trainer and/or rider of the horse entering the track who intends to work informs the "clockers" of the horse's name and the distance. The clockers must, to some degree, rely on this information and then utilize hand-held stopwatches to time the horses in these congested areas. This system is also subject to human error. Mistakes here are also commonplace.

Racetrack Stall Use

A trainer fills out a "stall application" for the assignment of stable space at racetracks. On that application the trainer lists the names and ages of horses that the trainer intends to bring to the grounds if sufficient stall space is assigned. The racetrack, through the race secretary's office is charged with the responsibility, during the "race meet" of assembling horses of equal competitiveness in order to put on a race program which will be wagered upon by the public. It is important that the horses to whom stalls are assigned will be competitors. There is little or no way for the race office or other racetrack officials to monitor the activity of horses to whom stalls are assigned unless there horses have in fact been entered into races or have had published workouts. The racetrack must also insure that all horses brought onto the grounds have been properly identified and have appropriate health certificate documentation.

Owner's Concerns

In thoroughbred and harness racing there are many owners who acquire large numbers of horses that are stationed at different racetracks and/or training farms throughout the country and, for that matter, the world. The owners then must rely upon conversations with the trainers as to the activity that the horses are being put in order to get them prepared for racing. These activities include timed workouts that are done at a track or a farm and also the distance and amount of exercise that a horse is receiving in order to prepare it for racing through which the horse will earn revenue.

SUMMARY OF THE INVENTION

The disclosed invention addresses resolution of serious deficiencies in the timing and movement of racing animals at racetracks and other locations. These needs are met by utilizing, refining, and applying modern computer satellite and tracking technology to an antiquated industry. The technology to be utilized includes adaptations of computer chips currently in domestic pet location use, global positioning satellite technology and on board transponders and uses modem communication technologies to centralize information flow and dissemination for efficient management of many aspects of the animal racing industry.

DETAILED DESCRIPTION OF THE INVENTION

Figure 1:
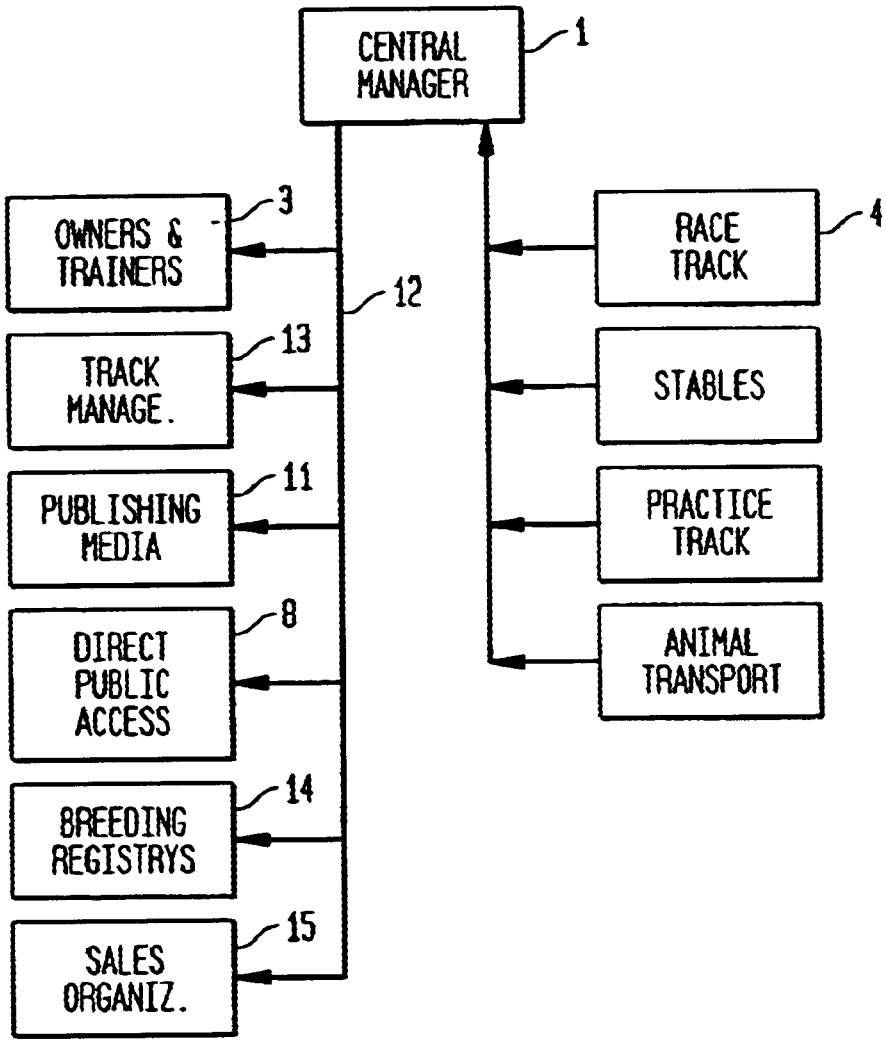
FIG. 1 is a schematic representation of information flow in a system and method of the invention.

The various situations described above are fraught with human error and problems. This is particularly dangerous in the highly regulated gaming sports. In order to address these problems, certain data and information must be gathered and distributed to individuals needing this information. (See FIG. 1.) This invention accomplishes this through the implanting a computer chip in the tendon, under the mane, or other appropriate location in the animal at a specific distance from the animal's head on each animal to be tracked. There are currently available chips that could be modified for equine use. Such devices and systems for their use are described, for example in U.S. Pat. Nos. 5,214,409, Des. 321,069, 4,333,072, and 4,234,326. The surgical procedure is rather simple and has been discussed with licensed veterinarians who could do it with no discomfort to the animal. Depending on the application, the chip would be implanted upon a horse entering the grounds of a racetrack at the "receiving barn" or if to be utilized by owners in the tracking of their stables, upon the acquisition of the animal. The chip would be "loaded" with the horses identification and current health certificate information.

Once the chip is installed the race office assigns each horse a stall. The tracking system detection units installed at the entrance to the racetrack, under the racetrack surface or a radio tower 2 in the track's infield reads the horses presence on the track each and every time. Thus the track management 4 has the ability to determine if the animal is in fact in training and going to the track on a regular basis to prepare for racing. In the event this horse is not, the racetrack 4 then can have the animal removed from the facility in order to utilize the space for active competitive animals, increasing the productivity of the barn area of each racetrack. This information is also transmitted to a central manager 1 server as part of the overall computer centered central management function. This information is of particular interest to owners and trainers 3. The central manager 1 function can be locally managed at a racetrack or by a central server 1 monitoring many locations and information sources.

Figure 2:
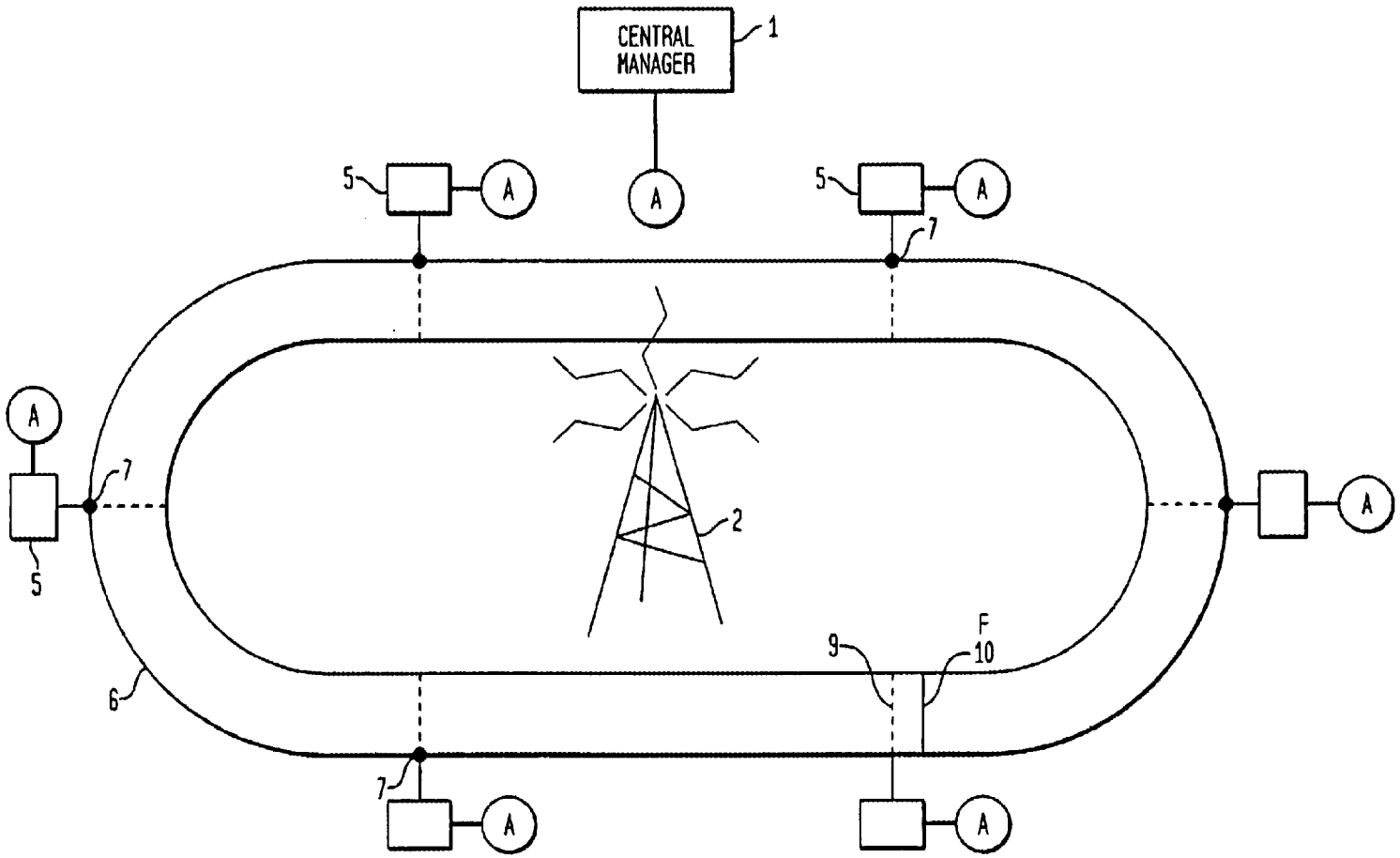
FIG. 2 is a schematic representation of a portion of a system of the invention installed at a race track.

The other racetrack application would be the timing of workouts and races. Since each horse has its own chip implant, the tracking device, via computer, could give the exact time that a horse is in any position on the racetrack through central coordination of signals from transponders 5 located around the track 6 or a central radio tower 2. If a horse is going to "work" for a half mile on a given morning, the information will be available on the racetrack computer and the need for practice clockers eliminated. The information can be gathered at exact locations on the racetrack by the installing of underground powered reading cables at each pole (distance marker) on the racetrack. (See FIG. 2.) Every morning workout would be accurately recorded and not subject to human error. In addition a power reading cable would be laced underground at the stable gate entrance and accurately monitor each horse entering and exiting the grounds illuminating the need for the often inaccurate sign in sign out sheet.

The Equine Tracking System is even more important to live racing. The use of a chip would totally eliminate the current inaccurate practice in guessing each horse other than the front-runner's time. An individual observing the race need no longer do the charting of a race; in fact, charting would be done by a consistent reading of the time of each horse, at any pole 7 during the race. Variances in acceleration could be calculated and this new information utilized by owners, trainers 3 and betters 8 in the industry. The most important aspect of the time of a race is the finish. All racetracks are equipped with photography equipment, which photographs the finish. Equine Tracking would supplement this task without the possibility of human error by installing a power cable 9 ten feet before the finish line 10. When the lead horse crosses this line the photo finish would be activated insuring an accurate photo.

All information regarding workouts and racing, which is considered "public information", will be electronically fed to a central computer system 1 which will be accessible by users 8 with a secure "PIN system" on a fee basis. Private information, such as an individual horse's daily routine, would be available to owners and trainers 3 through a secured "PIN system". Information providers 11, such as the Daily Racing Form, Equibase and handicapping guides could acquire and publish this "public information. This information can be made available over communication links 12 such as telecommunication lease line, cable, website, satellite or cellular telephone, as illustrated in FIG. 1.

Detection equipment, communication systems and analysis techniques for position monitoring and tracking are well known in the art. Exemplary disclosures hereby made part of this application have been published in the following PCT applications:

1) WO 01/14905 A1, entitled "System for Determining the Position of a Transponder";
2) WO 00/48132, entitled "System for Data Transfer Between Moving Objects and Fixed Stations";
3) WO 02/21151 A1, entitled "Measuring Station for a System for Determining the Position of a Transponder";
4) WO 99/53339, entitled "Tracking System for Sports".

An alternate system uses an independent powered transponder (tracking device). This transponder is linked to a satellite system similar to global positioning. Transponders are encoded with individual identification information and sold or leased to horse owners, trainers or racetracks. These individuals then direct their personnel to attach a transponder to a specific animals halter or bridle. The horses location and activity can then be monitored through a central computer system 1 that downlinks from the satellite. The owner 3, trainer 3 or racetrack 13 can then access the information through their computer with a secured PIN coded system. Owners/trainers 3 can then monitor their own horse's activity anywhere in the world.

Racetracks who run short or inexpensive race meets may be reluctant to utilize the solution that requires the construction of infrastructure. The alternate solution would provide these users with a timing method that is more accurate than the one currently use. The current method is inaccurate for all but the lead horse. Transponders will be purchased or leased by the racetrack, each transponder being numbered, for example, 1 through 10. When a horse has been identified in the paddock by the currently employed horse-identifier, the trainer is given a transponder, attached to the saddle pad that he is currently given or other part of the horse's tack. Each horse will then be tracked throughout the race in accordance with the above explanation, for example, through a central radio tower 2. At the end of the race when the identifier retrieves the saddle pad, the transponder along with the pad will be removed.

This system and method can be used, for example, in the following ways:

1. RACETRACKS: racetrack management 13 currently utilize outside vendors for photo-finish teletimer and race charter functions. They often receive unreliable information as to all but the lead horse. The funds currently being expended in this area could be utilized to receive accurate race information. Racetracks also employ individuals in the race office whose duties include assigning stall space based on horse utilization. Equine tracking data, as described above, can be utilized so that these offices are run in a more efficient and accurate manner thus insuring fuller competitive fields during the race meet and thereby increasing wagering income. Considerable time is also spent at the stable gate to verify the identity of horse entering and leaving the grounds and confirming that current health certificates are on file. The implanted chip is "loaded" with this information.
2. INFORMATION PROVIDERS: The Daily Racing Form, Equibase, Thorograph, Ragason and other information providers 11 rely on information gathered by employees, which may be inaccurate due to human error. This information is then sold to the racetracks 13 for program information and to the general public 11, 8 as wagering information. Using the herein-disclosed invention, individual clockers would no longer be necessary and the reliability and, therefore, desirability increased.
3. BEED REGISTRYS AND SALES COMPANIES: The organizations 14 that register athletic animals currently identify blood type and tattoo all animals in their breed. The herein-disclosed system can be utilized, in addition to these methods, in order to identify and locate breed animals. Sales companies 15 can supply potential purchasers with accurate training data and other information on the animals to be sold, thus providing dependable quality information.

4. OWNERS AND TRAINERS: These individuals 3 would be able to access closed private information regarding animals in their care or owned by them and in the care of others in order to accurately plan their racing campaigns.

While the above descriptions relate to horses and the horserace industry, other animal racing industries, such as the dog racing industry share similar concerns and needs. The herein disclosed systems and methods are equally applicable to such industries.

What is claimed is:

1. A method for computer based management in the animal racing industry comprising;

a) providing each animal with a transponder comprising an animal identifier unique to that animal and adapted for remotely communicating the animal identifier to a plurality of detector units;

b) providing at least one detector unit at each of a plurality of sensing locations selected from a list consisting of racetracks, stables, practice tracks, animal transport facilities and satelites;

c) sensing the presence of the transponder by at least one detector unit at a sensing time and determining the animal identifier;

d) transmitting information comprising the animal identifier and the sensing time to a central management server;

e) processing the information and transmitting processed information to a plurality of users selected from the list consisting of owners and trainers, racetrack managers, publishing media, direct public access vehicles, breeding registers and animal sales organizations.

2. A method of claim 1 comprising processing the information relating to a plurality of animals in order to time a race and determining an order of finishing.

3. A method of claim 1 comprising processing the information to determine animal exercising durations and lap times.

4. A method of claim 1 in which the animals are horses.

5. A method of claim 1 in which the animals are dogs.

6. A method of claim 1 in which access to portions of the information is restricted and available only to those organizations that have a right to that information.

7. A method of claim 6 in which access is restricted by a PIN-based system.

8. A method of claim 1 in which the transponder is surgically implanted in the animal as a permanent identifier.

9. A method of claim 1 in which the transponder is inserted in the animal's tack as a temporary identifier.

10. A method of claim 1 in which information is transmitted to the central management server by a plurality of local management servers, which servers collectively perform a central management function.

11. A method of claim 1 in which the transponder is a powered transponder adapted for communication with a global positioning system satellite.

12. A central management server computer for centralized management in the animal racing industry utilizing animal information from transponders associated with individual racing animals, comprising a host computer, telecommunications input and output ports, a database, and a plurality of software modules, installed in the host computer, selected from the group consisting of:

a) a module for receiving animal information from a racetrack and storing the animal information in the database;

b) a module for receiving animal information from animal housing facilities and storing the animal information in the database;

c) a module for receiving animal information from a practice track and storing the animal information in a database; and d) a module for receiving animal information from an animal transport vehicle and storing the animal information in the database;

e) a module for analyzing animal information and transmitting the animal information to owners and trainers;

f) a module for analyzing animal information and transmitting the animal information and analyzed animal information to racetrack management;

g) a module for analyzing animal information and transmitting the animal information and analyzed animal information to publishing media and to a vehicle for direct public access;

h) a module for analyzing animal information and transmitting the animal information and analyzed animal information to breeding registry organization and animal sales organizations.

* * * * *